US009162483B2

(12) United States Patent
Matsumoto

(10) Patent No.: US 9,162,483 B2
(45) Date of Patent: Oct. 20, 2015

(54) RECORDING APPARATUS

(71) Applicant: SEIKO EPSON CORPORATION, Tokyo (JP)

(72) Inventor: Akira Matsumoto, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/226,674

(22) Filed: Mar. 26, 2014

(65) Prior Publication Data

US 2014/0292985 A1 Oct. 2, 2014

(30) Foreign Application Priority Data

Mar. 27, 2013 (JP) ..... 2013-065785

(51) Int. Cl.
*B41J 11/04* (2006.01)
*B41J 11/00* (2006.01)
*B41J 15/04* (2006.01)

(52) U.S. Cl.
CPC ..... *B41J 11/001* (2013.01); *B41J 15/046* (2013.01)

(58) Field of Classification Search
CPC ..... B41J 11/001; B41J 11/04; B41J 15/046
USPC ..... 347/101, 104; 271/3.14
See application file for complete search history.

(56) References Cited

U.S. PATENT DOCUMENTS

2009/0267284 A1* 10/2009 Okuda et al. ..... 271/3.14

FOREIGN PATENT DOCUMENTS

| | | | |
|---|---|---|---|
| JP | 04-024528 | U | 2/1992 |
| JP | 05-186078 | A | 7/1993 |
| JP | 07-125349 | A | 5/1995 |

* cited by examiner

*Primary Examiner* — Manish S Shah
*Assistant Examiner* — Roger W Pisha, II
(74) *Attorney, Agent, or Firm* — Maschoff Brennan

(57) ABSTRACT

A recording apparatus includes a medium supporting section that supports a recording medium, a recording section that performs a recording on the recording medium, and a medium path that has a first face and a second face facing each other, and that transports the recording medium through between the first face and the second face. The first face has a shape which is convex toward the second face. A plurality of rollers which are lined up in a transport direction of the recording medium are arranged on the first face.

4 Claims, 7 Drawing Sheets

RECORDING APPARATUS

BACKGROUND

1. Technical Field

The present invention relates to a recording apparatus.

2. Related Art

In a recording apparatus such as a large ink jet printer, there is a recording apparatus that feeds a sheet from rolled papers (recording mediums) which are mounted on a rolled paper mounting section and performs a printing through a medium path. The medium path of the recording apparatus described above is bent in accordance with a position relationship between a recording section that performs the printing and the rolled paper mounting section. In the middle of the medium path, for example, a pair of transport rollers that pinch the sheet in front of the recording section, and a pair of paper feeding rollers that feed the sheet to the pair of the transport rollers, are arranged.

When the pair of the transport rollers pinch and transport the sheet at the time of printing, there is a possibility that the sheet comes into contact with an inner face of an inner circumference side of the bent medium path. In this case, there is a possibility that a scratch occurs in a sheet face which faces the inner face of the inner circumference side. Moreover, in a case of feeding a new rolled paper, there is possibility that the sheet comes into contact with the inner face of an outer circumference side of the bent medium path. In this case, there is possibility that the scratch occurs in the sheet face which faces the inner face of the outer circumference side.

The problems described above are also present in various recording apparatuses without being limited to the ink jet printer.

Furthermore, since an image recording apparatus which is disclosed in JP-A-5-186078 is an apparatus that feeds a cut sheet, there is no consideration of the problems that occur in case of the rolled paper. In the image recording apparatus, the transport path is bent in order to prevent a jam of the cut sheet. Even in the apparatus, when a pair of resist rollers pinch and transport the cut sheet at the time of printing, since the cut sheet comes into contact with a paper guide, there is a possibility that the scratch occurs in the sheet face which faces the paper guide of the inner circumference side or the sheet face which faces the paper guide of the outer circumference side.

SUMMARY

An advantage of some aspects of the invention is to provide a recording apparatus which can suppress damage of a recording medium due to contact with an inner face of a medium path.

According to an aspect of the invention, there is provided a recording apparatus including a medium supporting section that supports a recording medium, a recording section that performs a recording on the recording medium, and a medium path that has a first face and a second face facing each other, and that transports the recording medium through between the first face and the second face, in which the first face has a shape which is convex toward the second face, and a plurality of rollers which are lined up in a transport direction of the recording medium are arranged on the first face.

That is, since the plurality of the rollers are lined up in the transport direction of the recording medium on the first face having the shape which is convex toward the second face, the recording medium is prevented from being directly scratched on the first face. Therefore, according to the aspect described above, it is possible to provide a recording apparatus which can suppress the damage of the recording medium due to the contact with the first face having the shape which is convex toward the second face.

Here, the recording apparatus described above includes an ink jet printer, a wire dot printer, a laser printer, a line printer, a copy machine, a facsimile machine or the like.

The first face and the second face may be a part of a medium path face. Therefore, the second face may be located on a medium path downstream side of the first face, or the first face may be located on the medium path downstream side of the second face.

A common tangent of the two adjacent rollers in the transport direction may not come into contact with the first face which is located between the two rollers in the medium path. In this case, since the contact between the first face and the recording medium can be more effectively reduced, it is possible to provide a preferable example which can suppress the damage of the recording medium.

The second face may have a shape which is concave toward an opposite side of the first face, and a second roller may be arranged on the second face. In this case, since it is suppressed that the recording medium is directly scratched on the second face, it is possible to provide a recording apparatus which can suppress the damage of the recording medium due to the contact with the second face having the shape which is concave toward the opposite side of the first face at the time of supplying the recording medium.

The second roller may be arranged on the second face of a position which is located between the two adjacent rollers that are arranged on the first face in the transport direction. In this case, it is possible to provide the example which can suppress the damage of the recording medium due to the contact with the medium path face while suppressing the number of rollers.

On the first face, an extending section may be formed along the transport direction. In this case, since the contact between the first face and the recording medium can be more effectively reduced, it is possible to provide the preferable example which can suppress the damage of the recording medium due to the contact with the first face having the shape which is convex toward the second face.

The second face may be formed into a curved shape. Since a tip section of the recording medium is not held at the time of supplying the recording medium, the recording medium is likely to come into contact with the second face having the concave shape. If the extending section is provided on the second face having the concave shape, a contact area between the second face and the recording medium is reduced. As a result, the scratch of the recording medium is more likely to occur. Accordingly, in this case, it is possible to provide the preferable example which can suppress the damage of the recording medium due to contact with the second face having the shape which is concave toward the opposite side of the first face at the time of supplying the recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described. Naturally, the following embodiments are only used to exemplify the invention, and all of characteristics which are shown in the embodiments are not necessarily provided in the apparatus according to the invention.

Figure 1:
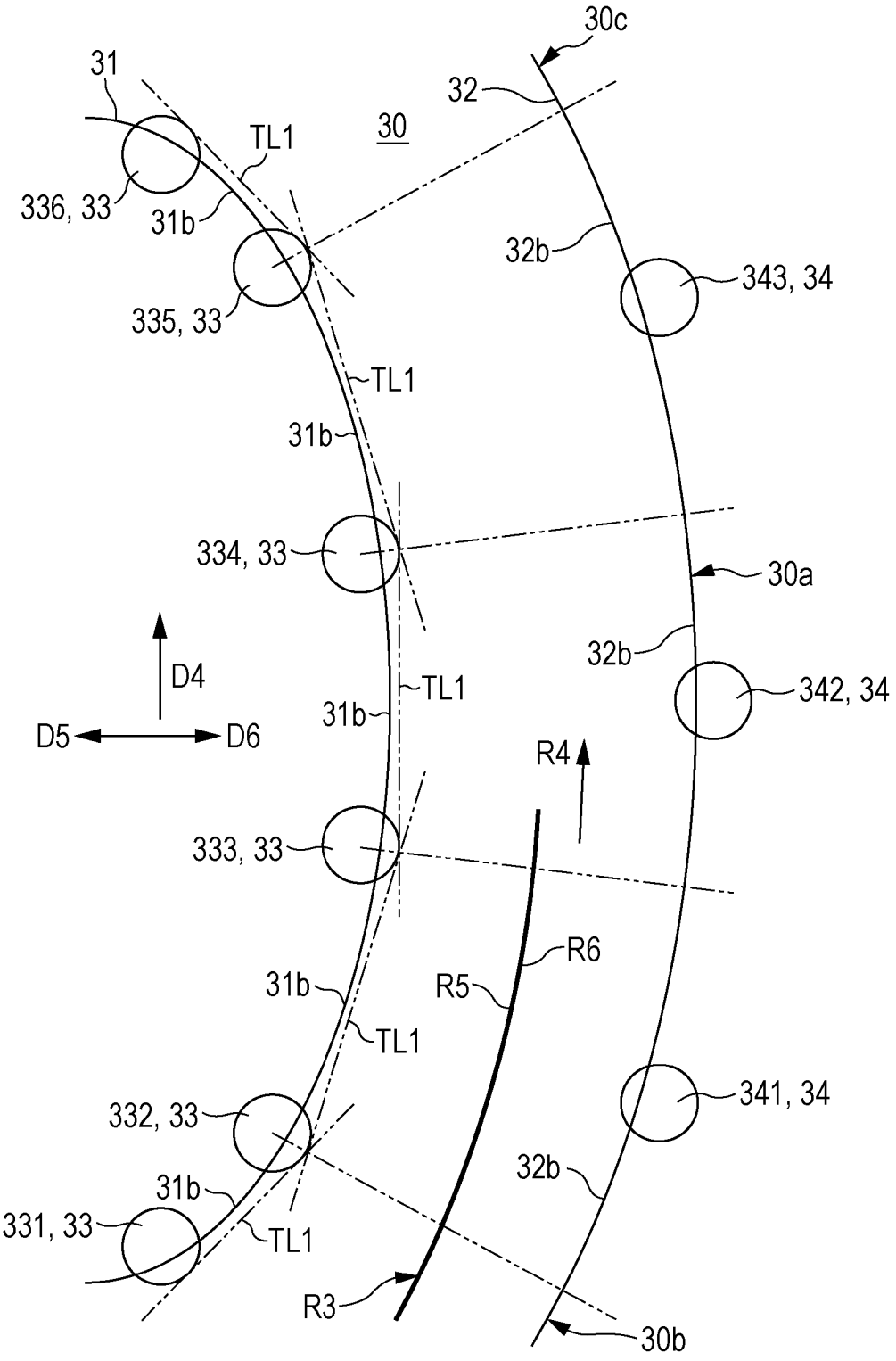
FIG. 1 is a view schematically illustrating a main section of a medium path.
Figure 2:
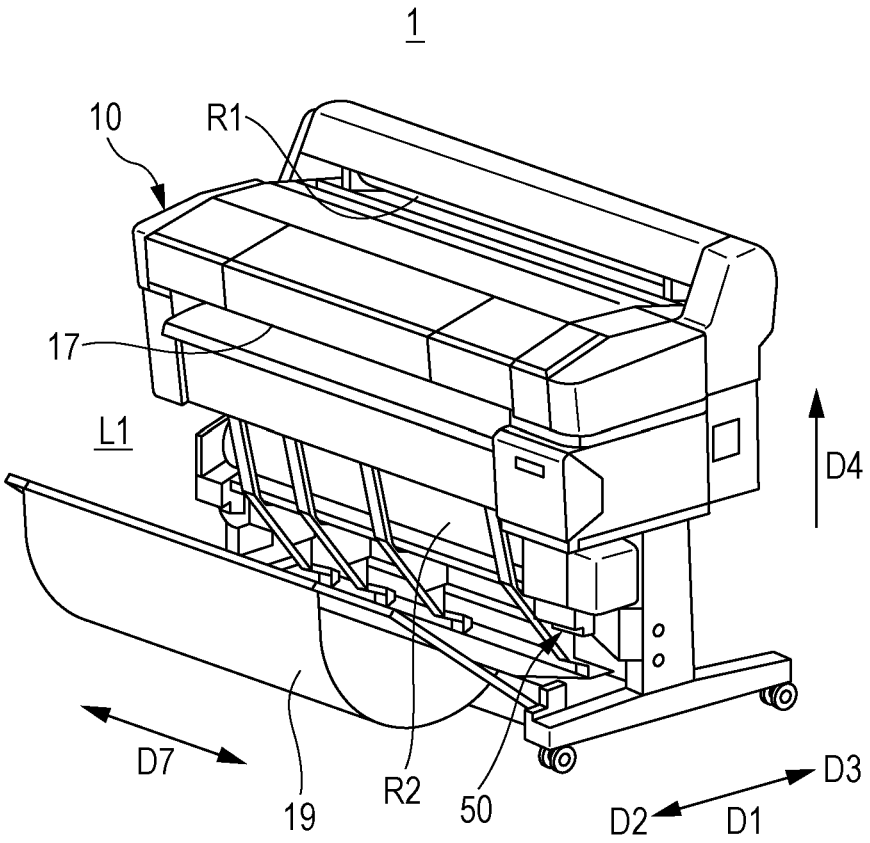
FIG. 2 is a perspective view illustrating an appearance of a recording apparatus.
Figure 3:
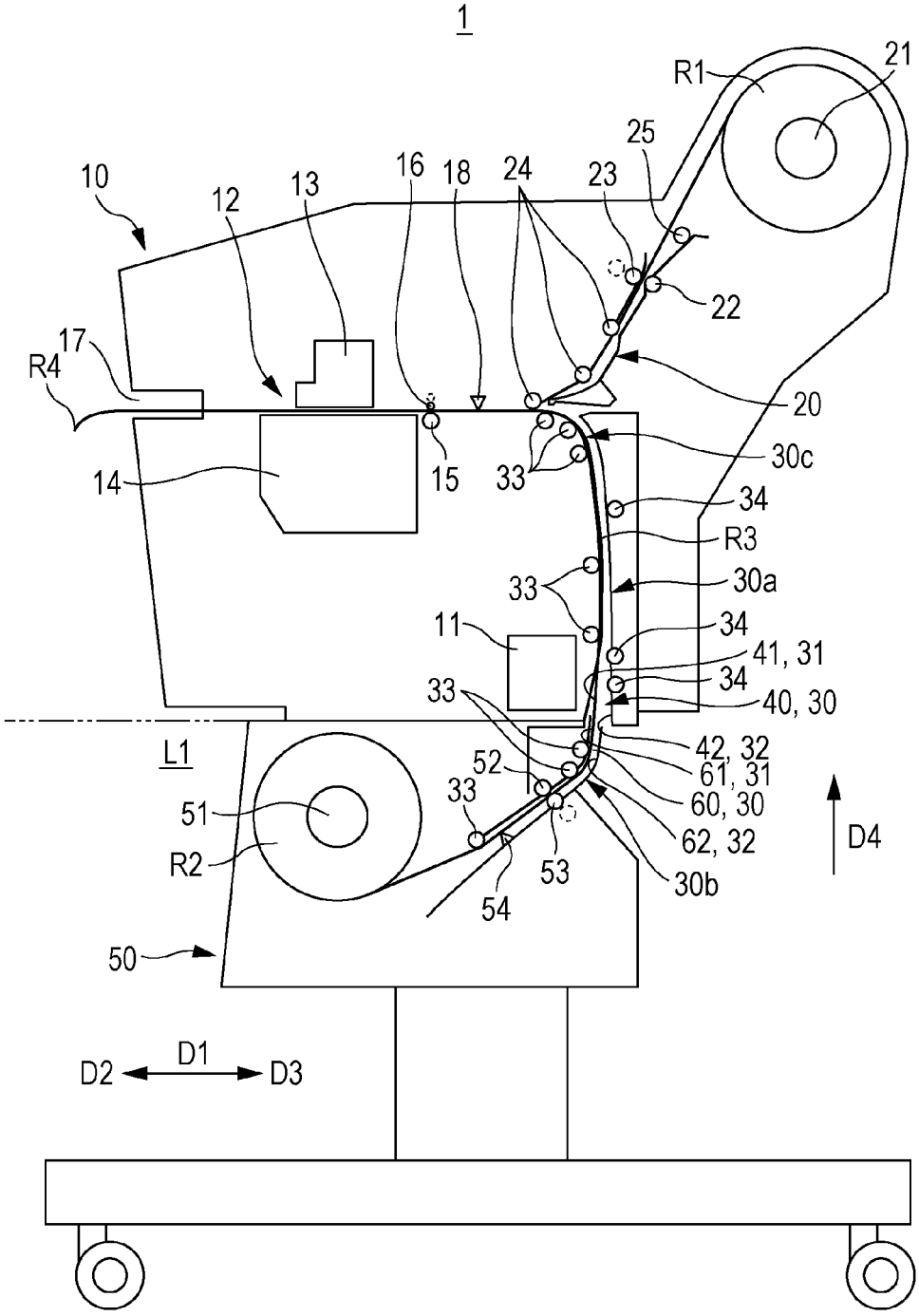
FIG. 3 is a longitudinal sectional view illustrating the recording apparatus.
Figure 4:
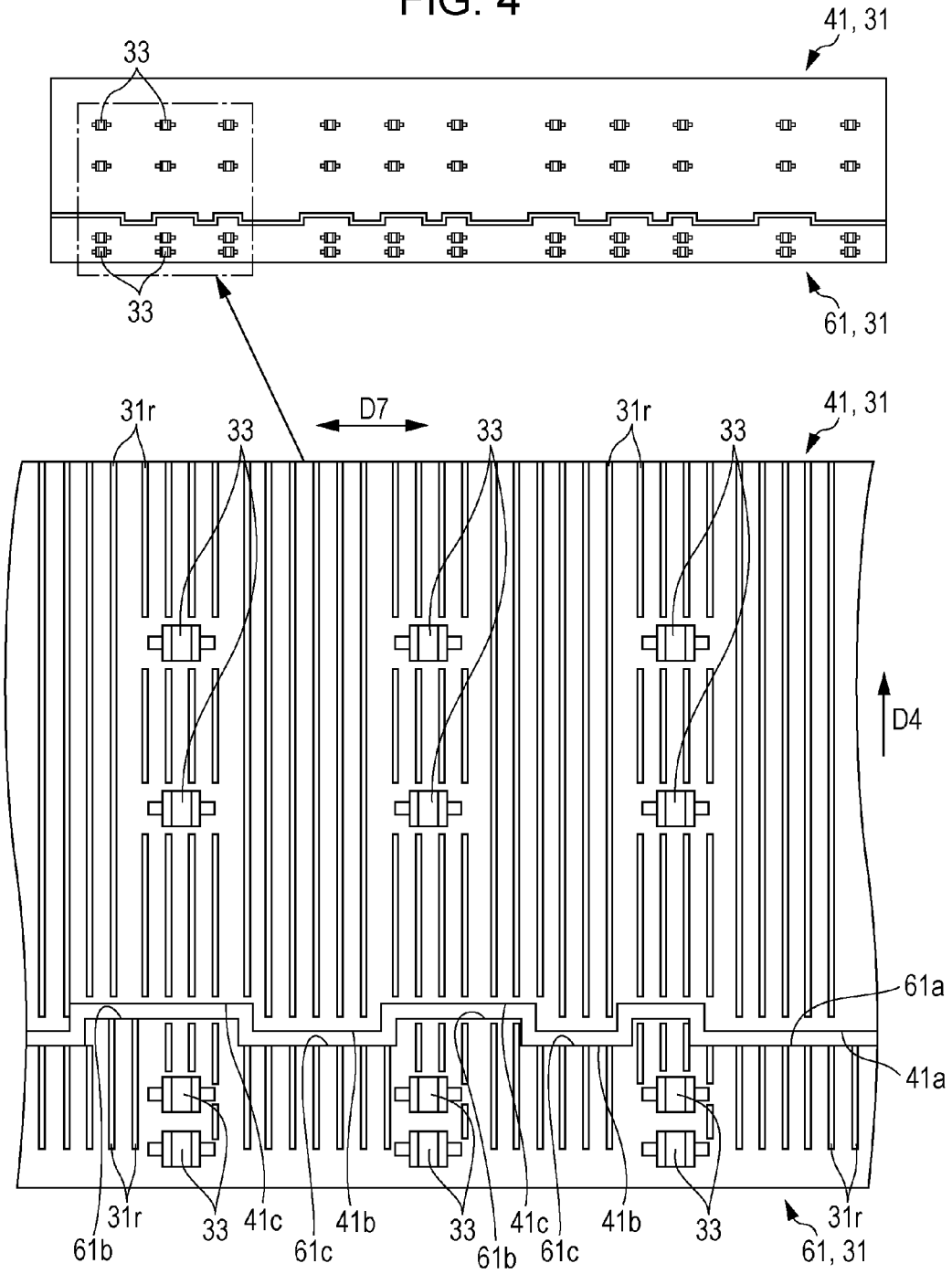
FIG. 4 is rear view illustrating an inner face (first inner face) of an inner circumference side of the medium path.
Figure 5:
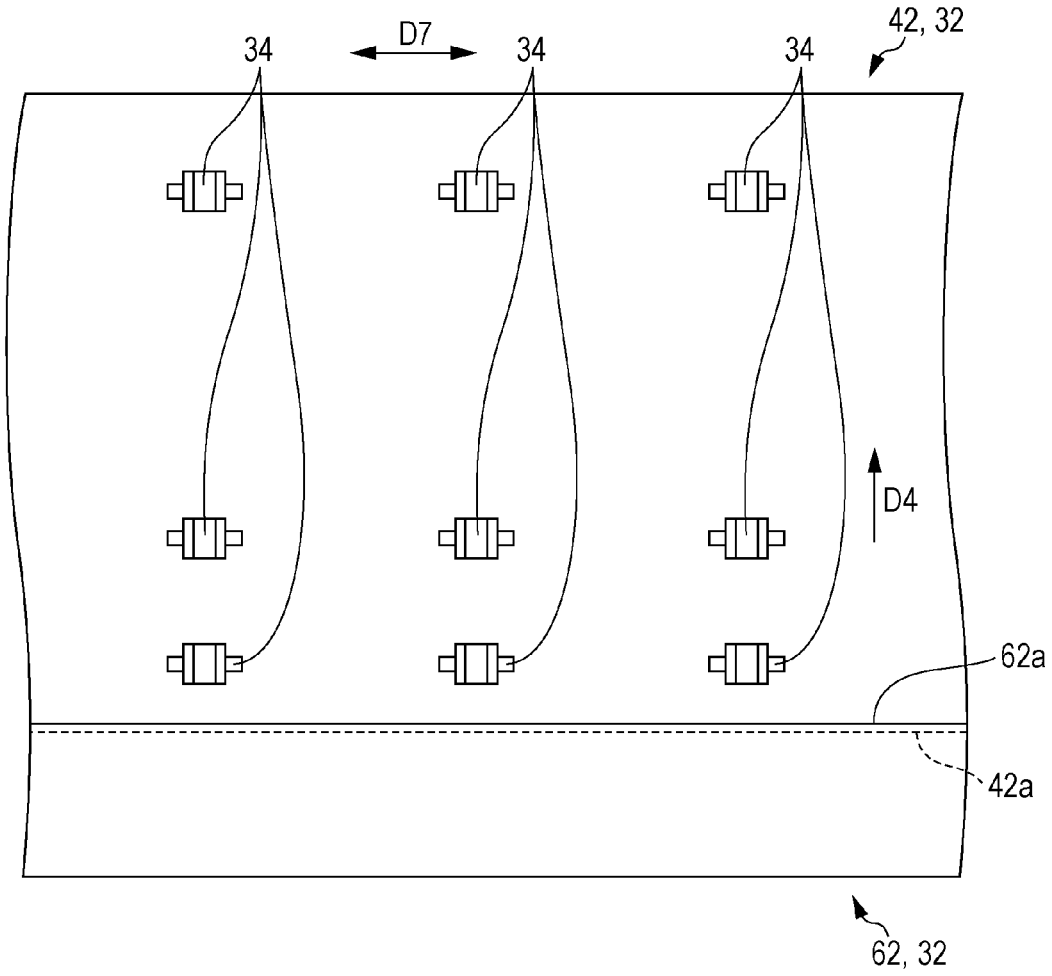
FIG. 5 is a front view illustrating an inner face (second inner face) of an outer circumference side of the medium path.
Figure 6:
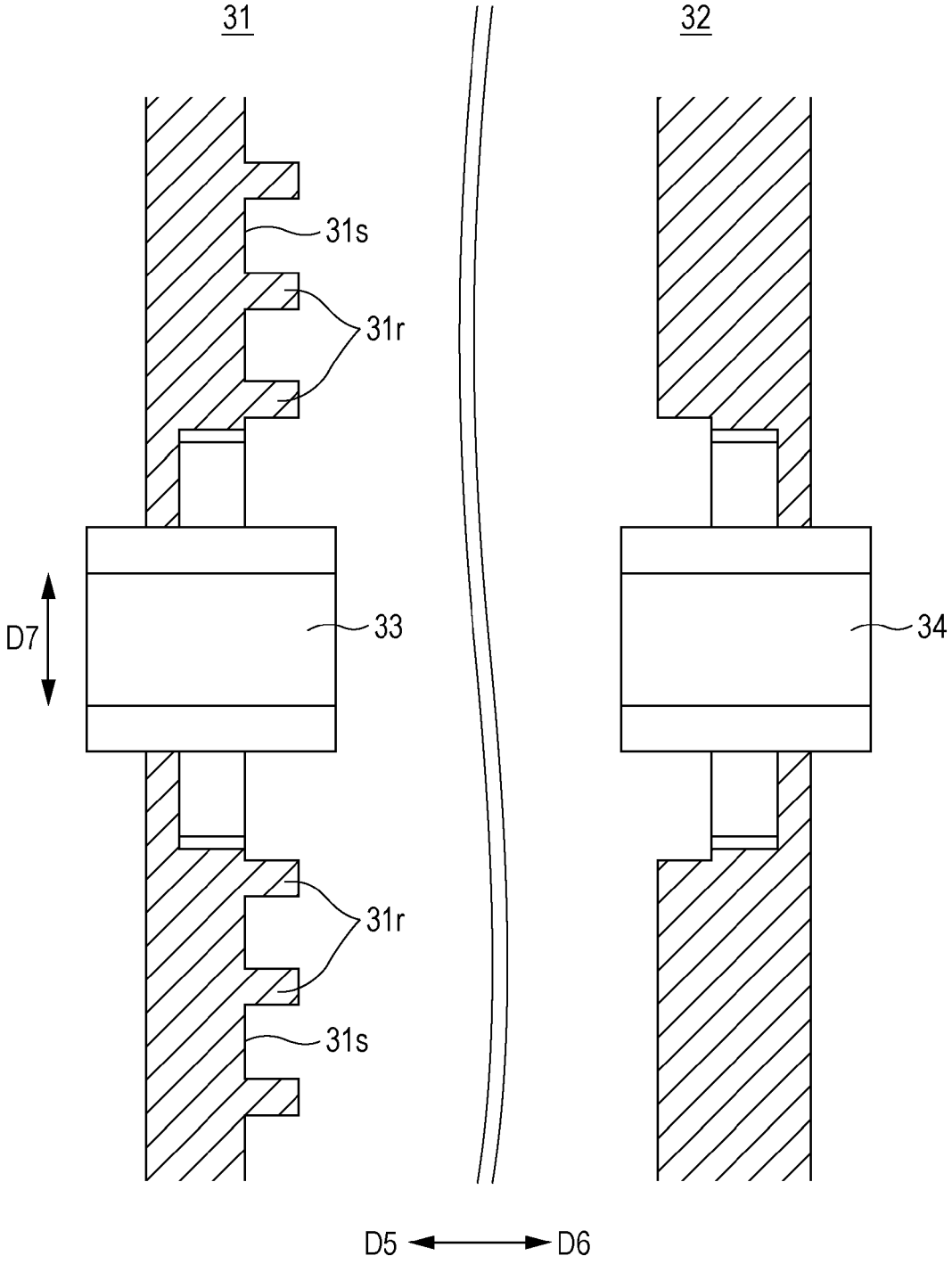
FIG. 6 is a cross-sectional view illustrating the inner faces of the medium path.

FIG. 1 is a view schematically illustrating a main section of a medium path 30 of a recording apparatus in order to describe an example of the present technology. FIG. 2 is a perspective view illustrating an appearance of a large ink jet printer as an example of a recording apparatus 1. FIG. 3 is a longitudinal sectional view illustrating the recording apparatus 1 except for a stacker 19. FIG. 4 is a rear view illustrating an inner face 31 of an inner circumference side of the medium path 30. FIG. 5 is a front view illustrating an inner face 32 of an outer circumference side of the medium path 30. FIG. 6 is a cross-sectional view illustrating the inner faces 31 and 32 of the medium path 30.

In the drawings described above, a mark D1 indicates a slide direction of a paper feeding unit 50 with respect to a housing 10. A mark D2 indicates a pull-out direction which is one side in the slide direction. A mark D3 indicates a pull-in direction which is the other side in the slide direction. A mark D4 indicates a transport direction of a sheet (recording medium) R3 intersecting the slide direction D1. A mark D5 is an inner direction toward the inner face 31 of the inner circumference side from the inner face 32 of the outer circumference side. A mark D6 is an outer direction toward the inner face 32 of the outer circumference side from the inner face 31 of the inner circumference side. A mark D7 indicates a width direction of the recording apparatus which is perpendicular to the transport direction D4, the inner direction D5 and the outer direction D6. FIG. 1 is a side view of the medium path 30 when seen from an outside in the width direction D7, and FIG. 3 is a side view of the recording apparatus 1 when seen from the outside in the width direction D7.

In addition, in order to show simply, the figures of respective drawings are not always consistent.

A position relationship which is described in the present specification is only an exemplary example in order to describe the invention, and does not limit the invention. Therefore, in addition to a lower position of the housing, the invention also includes that for example, the paper feeding unit is arranged at the upper, left, or right position thereof.

The recording apparatus 1 which is shown in the drawings described above includes the housing 10 and the paper feeding unit 50 which is arranged slidably with respect to the housing 10. The recording apparatus 1 can print (perform a recording) by switching a first rolled paper R1 inside of an upper portion of the apparatus and a second rolled paper R2 l of a lower portion of the apparatus. The rolled paper is a continuous paper which is formed by winding a sheet into a roll shape. In both of the rolled papers R1 and R2, the outsides thereof are used as a printing face. Naturally, if the position of a feeding mechanism 21 and a feeding mechanism 51 is changed, the rolled paper of which the inside is the printing face can be used. As the rolled paper, it is possible to use a winding sheet of various materials such as paper, cloth, a plastic sheet and a leather.

As shown in FIG. 3, the housing 10 includes a control section 11, a recording section 12, a pair of transport rollers (15, 16), a discharge section 17, a cutter 18, the stacker 19, a medium path 20 for the first rolled paper, paper feeding mechanisms (21 to 25), a first medium path 40 for the second rolled paper, rollers (driven rollers) 33 and 34, or the like.

The control section 11 has a CPU (Central Processing Unit), a ROM (Read Only Memory), a RAM (Random Access Memory) or the like, and controls an operation of each unit of the recording apparatus 1 such that an instruction of an recording output is received from an external host apparatus and the printing is performed on the recording medium having the sheet shape. The recording medium which is subject to printing is the portion which is pulled out from one of the rolled papers R1 and R2, and is a sheet R3 which is continuous in the case of the second rolled paper R2.

The recording section 12 has a recording head 13 and a platen 14. The recording head 13 is arranged on an upper side facing the platen 14, and can perform the recording by discharging an ink onto the recording medium. The platen 14 supports the recording medium, and maintains a predetermined distance between the recording medium and the recording head 13.

The pair of the transport rollers (15, 16) includes a drive roller 15 which is arranged on a lower side and a driven roller 16 which is arranged on an upper side. The driven roller 16 can be separated from the drive roller 15, and pinches the recording medium with the drive roller 15 at the time of approaching.

The recording medium is sent out from the discharge section 17, is cut by the cutter 18, is released from pinching between the pair of the transport rollers (15, 16) and is stacked on the stacker 19.

The paper feeding mechanism for the first rolled paper includes a feeding mechanism 21 that supports the first rolled paper R1, a pair of paper feeding rollers (22, 23), rollers (driven rollers) 24 and 25, or the like. The pair of the paper feeding rollers (22, 23) includes a drive roller 22 which is arranged on the outer circumference side of the medium path 20, and a driven roller 23 which is arranged on the inner circumference side of the medium path 20. The driven roller 23 can be separated from the drive roller 22, and pinches the recording medium with the drive roller 22 at the time of approaching. The roller 24 is located on a wall of the inner circumference side of the medium path 20, and comes slightly out inside the medium path 20 from the inner face of the wall. The roller 25 is located on the wall of the outer circumference side of the medium path 20, and comes slightly out inside the medium path 20 from the inner face of the wall.

At the time of feeding a new first rolled paper R1 which is mounted on the feeding mechanism 21, first, a user puts a tip section of the rolled paper R1 between the pair of the paper feeding rollers (22, 23). Thereafter, the feeding mechanism 21 feeds the rolled paper R1, the pair of the paper feeding rollers (22, 23) pinch the fed sheet and transport the sheet toward the pair of the transport rollers (15, 16), and the pair of the transport rollers (15, 16) pinch the sheet. At the time of printing, the pair of the transport rollers (15, 16) transport the sheet onto the platen 14, the recording head 13 discharges the ink onto the sheet, and the recording is performed.

The paper feeding unit 50 includes the feeding mechanism (medium supporting section) 51 that supports the second rolled paper R2, a pair of the paper feeding rollers (52, 53), a medium detection sensor 54, the roller (driven roller) 33 of a first roller which is located on the wall of the inner circumference side of the second medium path 60, or the like. The paper feeding unit 50 can slide between a pull-in position L1 and a pull-out position, and is electrically connected to the control section 11.

The pair of the paper feeding rollers (52, 53) includes a drive roller 52 which is arranged on the inner circumference side of the second medium path 60, and a driven roller 53 which is arranged on the outer circumference side of the second medium path 60. The driven roller 53 can be separated from the drive roller 52, and pinches the sheet R3 with the drive roller 52 at the time of approaching. The medium detection sensor 54 detects whether or not the sheet R3 is supplied in front of the pair of the paper feeding rollers (52, 53) in the second medium path 60.

At the time of feeding a new second rolled paper R2 which is mounted on the feeding mechanism 51, first, the user puts a tip section R4 of the rolled paper R2 between the pair of the paper feeding rollers (52, 53). Thereafter, the feeding mechanism 51 feeds the rolled paper R2, the pair of the paper feeding rollers (52, 53) in the second medium path 60 pinch the fed sheet R3 and transport the sheet R3 toward the first medium path 40. At this time, since the tip section R4 of the sheet is bent by a winding curl of the rolled paper R2, there is a case of coming into contact with one side wall sections 41 and 61 or a case of coming into contact with the other side wall sections 42 and 62. Therefore, the pair of the transport rollers (15, 16) pinch the sheet R3 which has passed the first medium path 40 and is transported to between the pair of the transport rollers (15, 16). Thereafter, the pair of the paper feeding rollers (52, 53) may release the sheet R3 from pinching. At the time of printing (recording), the pair of the transport rollers (15, 16) transport the sheet R3 onto the platen 14, the recording head 13 discharges the ink onto the sheet R3, and the recording is performed. A series of the operations is controlled by the control section 11. When the sheet R3 is not detected by the medium detection sensor 54, the control section 11 does not perform the series of the operations described above.

At the time of feeding the paper described above, since the sheet R3 of a downstream side of the medium path from the pair of the paper feeding rollers (52, 53) is not pulled into the pair of the transport rollers until pinching between the pair of the transport rollers (15, 16), a tension is not applied thereon. At the time of printing, since the sheet R3 of an upstream side of the medium path is held by the feeding mechanism 51 and the sheet R3 of the downstream side of the medium path is pulled into the pair of the transport rollers (15, 16), the tension is applied to the sheet R3.

Furthermore, the drive roller and the driven roller configuring the pair of the rollers may be in a reverse arrangement of the position relationship described above. Moreover, the pair of the rollers may be configured by the pair of the drive rollers using the drive roller instead of the driven roller.

The medium path 30 of the technology is configured by the first medium path 40 and the second medium path 60 described above.

As shown in FIG. 1, the medium path 30 has the first inner face 31 and the second inner face 32 between which the sheet (recording medium) R3 is transported. Here, the first inner face 31 is the face facing one face (inside face R5) of the transported sheet R3, the inner face of a center side of curvature (inner circumference side) of the bent medium path 30 in the example of FIG. 1, and the convex face. The second inner face 32 is the face facing the other face (outside face R6) of the transported sheet R3, the inner face of the outer circumference side of the medium path 30 in the example of FIG. 1, and the concave face. In the medium path 30 of FIG. 3, large curvature sections 30*b* and 30*c* having relatively large curvature (small radius of curvature) are arranged on the upstream side and the downstream side of a small curvature section 30*a* having relatively small curvature (large radius of curvature) which is formed in the approximately vertical direction. The pair of the paper feeding rollers (52, 53) are arranged on the upstream side of the large curvature section 30*b*, and the pair of the transport rollers (15, 16) are arranged on the downstream side of the large curvature section 30*c*.

The inner face 31 of the inner circumference side is configured of the first one side wall section 41 and the second one side wall section 61, as shown in FIG. 3 and FIG. 4, and has a shape which bulges toward the transported sheet R3 (in outer direction D6). The bulging shape of the inner face 31 of the inner circumference side means that the inner face 31 is convex in the direction toward the inner face 32 of the outer circumference side. A margin section 41*a* of the second one side wall section 61 side is formed into a comb shape by repeating a convex section 41*b* and a concave section 41*c* having rectangular shape alternately in the first one side wall section 41. A margin section 61*a* of the first one side wall section 41 side is formed into the comb shape by repeating a convex section 61*b* and a concave section 61*c* having rectangular shape alternately in the second one side wall section 61. Specifically, when viewed from the pull-out direction D2 and the pull-in direction D3, the convex section 61*b* of the second one side wall section 61 enters the concave section 41*c* of the first one side wall section 41 at intervals and the convex section 41*b* of the first one side wall section 41 enters the concave section 61*c* of the second one side wall section 61 at intervals.

Furthermore, as shown in FIG. 4 and FIG. 6, a rib (extending section) 31*r* of which the longitudinal direction is toward the transport direction D4 of the sheet R3 is formed in the inner face 31 of the inner circumference side. The rib 31*r* extends toward the outer direction D6 within a range that does not exceed a protrusion of the roller 33 from a base face 31*s* of the inner face 31.

As shown in FIG. 3 and FIG. 5, the inner face 32 of the outer circumference side is configured of the first other side wall section 42 and the second other side wall section 62, and has the shape which is concave toward an opposite side (in inner direction D5) of the transported sheet R3. When the paper feeding unit 50 is positioned in the pull-in position L1, a margin section 62*a* of the second other side wall section 62 is distantly positioned to the pull-out direction D2 side with respect to a margin section 42*a* of the first other side wall section 42. As shown in FIG. 5 and FIG. 6, in contrast with the inner face 31 of the inner circumference side, the inner face 32 of the outer circumference side is formed into a curved shape without the extending section of which the longitudinal direction is toward the transport direction D4.

As shown in FIG. 3 and FIG. 4, the roller 33 is a plurality of the first rollers which are lined up in the transport direction D4 of the sheet R3. The roller 33 is arranged on the inner face 31 of the inner circumference side. Rows of the rollers 33 which are lined up in the transport direction D4 are plurally arranged in the width direction D7. Each roller 33 is attached to the one side wall sections 41 and 61 with the width direction D7 as the rotation axis, respectively, and each roller 33 comes slightly out inside the medium path 30 (in outer direction D6) from the inner face 31, specifically the rib 31*r*. A curved line representing the inner face 31 in FIG. 1 corresponds to an extending end of the rib 31*r*.

As described above, at the time of printing, since the tension is applied to the sheet R3 by the tensile force from the pair of the transport rollers (15, 16), there is a possibility that the sheet R3 is pulled toward the inner circumference side of the medium path 30. When a line of the roller is not arranged on the inner face of the inner circumference side along the transport direction as the image recording apparatus which is disclosed in JP-A-5-186078, the inside face of the transported sheet is likely to scratch on the inner face of the inner circumference side, and there is the possibility that the scratch occurs on the inside face of the sheet. Furthermore, since the technology of the image recording apparatus described above is used in order to prevent a jam of a cut sheet, there is no consideration of the problem that the scratch occurs on the continuous paper such as the rolled paper. Since a part of the paper waits in the medium path in the middle of the printing operation in a case of a long paper such as the rolled paper, there is the possibility that adverse effects such as occurring of the scratch and reducing of transport accuracy on a printing result occur according to the state of waiting. The first roller 33 suppresses the adverse effect such as the scratch described above.

As illustrated in FIG. 1, a common tangent TL1 of the two adjacent rollers 33 in the transport direction D4 does not come into contact with an inner face 31*b* of the inner circumference side which is located between the two rollers 33 in the medium path 30. Naturally, the common tangent TL1 is the common tangent to adjacent rollers of the portion which comes out in the medium path 30 in a cross section which passes the transport direction D4, the inner direction D5 and the outer direction D6, that is, a longitudinal section perpendicular to the width direction (D7) of the sheet R3. Since the common tangent TL1 and the inner face 31*b* between the first rollers 33 are prevented from intersecting with each other while suppressing the number of the rollers, the interval between rollers 333 and 334 which are adjacent to each other in the small curvature section 30*a* is relatively wide, and the interval between rollers 331 and 332 which are adjacent to each other in the large curvature section 30*b* and the interval between rollers 335 and 336 which are adjacent to each other in the large curvature section 30*c* are relatively narrow.

As shown in FIG. 3 and FIG. 5, the roller 34 is arranged on the inner face 32 of the outer circumference side. The roller 34 is the plurality of the second rollers which are lined up in the transport direction D4 of the sheet R3. The rows of the rollers 34 which are lined up in the transport direction D4 are plurally arranged in the width direction D7. Each roller 34 is attached to the small curvature section 30*a* of the first other side wall section 42 with the width direction D7 as the rotation axis, respectively, and thus, each roller 34 comes slightly out inside the medium path 30 (in inner direction D5) from the inner face 32.

As described above, at the time of feeding the paper, since the tension is not applied to the sheet R3 by the pair of the transport rollers until the sheet R3 is pinched between the pair of the transport rollers (15, 16), there is the possibility that the sheet R3 approaches toward the outer circumference side of the medium path 30. If the sheet R3 is hard, it is likely to approach toward the outer circumference side in particular. When the second roller is not arranged as the image recording apparatus which is disclosed in JP-A-5-186078, the outside face of the transported sheet is likely to scratch on the inner face of the outer circumference side, and there is the possibility that the scratch occurs on the outside face of the sheet. The second roller 34 suppresses the adverse effects such as the scratch and the like as described above. In particular, when the small curvature section 30*a* is positioned on the downstream side of the large curvature section 30*b*, since the sheet R3 is likely to scratch on the inner face 32 of the outer circumference side of the small curvature section 30*a*, it is effective to arrange the second roller in the small curvature section 30*a*.

In the example of FIG. 1, the second roller 34 is arranged on the inner face 32*b* of the outer circumference side of a position which is located between the two adjacent first rollers 33 that are arranged on the inner face 31 of the inner circumference side in the transport direction D4. In FIG. 1, a second roller 341 is arranged on the inner face 32*b* between the first rollers 332 and 333, a second roller 342 is arranged on the inner face 32*b* between the first rollers 333 and 334, and a second roller 343 is arranged on the inner face 32*b* between the first rollers 334 and 335. It is preferable that the position of the second roller 34 is located in approximately an intermediate position, from the viewpoint of increasing a depression effect with respect to the damage of the sheet R3 due to the contact with the inner face 32 of the outer circumference side while suppressing the number of the rollers. However, the depression effect with respect to the damage can be obtained while suppressing the number of the rollers, if the second roller 34 is located in the position which does not face the first roller 33, other than approximately the intermediate position. In addition, even when only one second roller 34 is arranged in the transport direction D4, the depression effect with respect to the damage can be obtained.

Next, the operations and the effects of the recording apparatus 1 will be described.

As described above, since the plurality of the rollers 33 which are lined up in the transport direction D4 are arranged on the first inner face 31 of the inner circumference side which bulges toward the transported sheet R3, it is suppressed that the inside face R5 of the sheet R3 comes into contact with the inner face 31 directly. In particular, at the time of printing, since the sheet R3 which is fed from the feeding mechanism 51 is pinched by the pair of the transport rollers (15, 16) and is pulled out, as a sheet R31 shown in FIG. 7, the sheet R31 may be arranged along the common tangent TL1 of the rollers 33 which are adjacent to each other in the transport direction D4. In this case, since the common tangent TL1 is separated from the inner face 31, it is possible to more effectively reduce the contact between the inside face R5 of the sheet and the inner face 31 of the medium path.

Accordingly, the recording apparatus 1 can suppress the damage of the inside face R5 of the sheet due to the contact with the inner face 31 of the medium path having the shape which bulges toward the transported sheet R3.

Furthermore, since the rib 31*r* of which the longitudinal direction is toward the transport direction D4 is formed on the inner face 31 of the inner circumference side as shown in FIG. 4 and FIG. 6, it is possible to more effectively reduce the contact between the inside face R5 of the sheet and the inner face 31. Moreover, the static electricity is suppressed since the contact area is reduced. Even in terms of the aspects, the recording apparatus 1 can suppress the damage of the inside face R5 of the sheet due to the contact with the inner face 31 of the inner circumference side.

Figure 7:
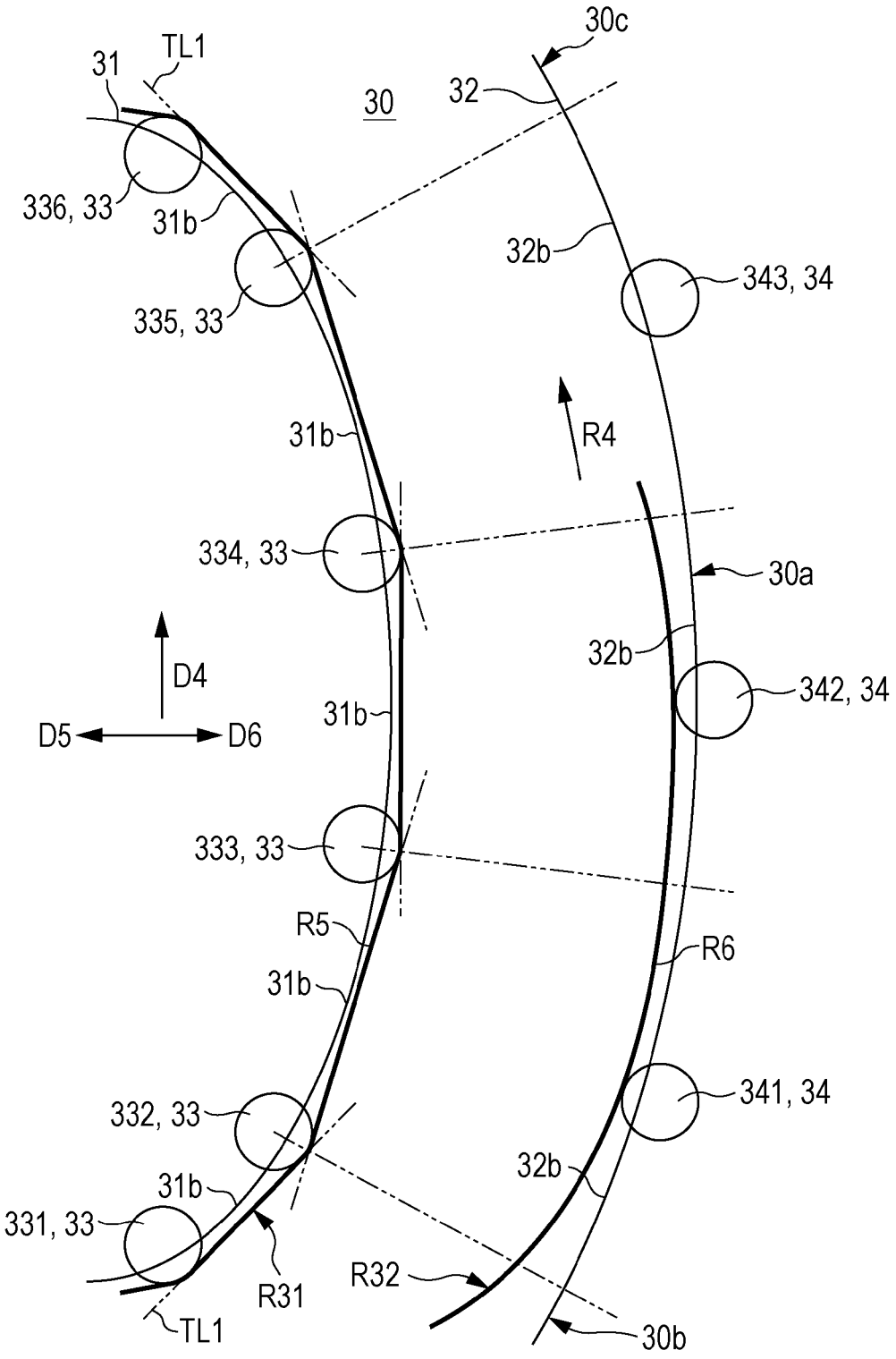
FIG. 7 is a side view illustrating an operation of the recording apparatus.

In addition, since the second roller 34 is arranged on the second inner face 32 of the outer circumference side which is concave toward the opposite side of the transported sheet R3, as a sheet R32 shown in FIG. 7, it is suppressed that the outside face R6 of the sheet R32 is directly scratched on the inner face 32. In particular, since the plurality of the rollers 34 which are lined up in the transport direction D4 are arranged on the inner face 32 of the outer circumference side, it is possible to more effectively reduce the contact between the outside face R6 of the sheet and the inner face 31.

Accordingly, the recording apparatus 1 can suppress the damage of the outside face R6 of the sheet due to the contact with the inner face 32 of the medium path having the shape which is concave toward the opposite side of the transported sheet R3.

Furthermore, the second roller 34 is arranged on the inner face 32*b* of the outer circumference side. The second roller 34 is positioned between the rollers 33 which are arranged on the inner face 31 of the inner circumference side and are adjacent to each other in the transport direction D4. Therefore, the recording apparatus 1 can suppress the damage of the outside face R6 of the sheet due to the contact with the inner face 32 of the medium path while suppressing the number of the rollers.

At the time of feeding a new second rolled paper R2, since the tip section R4 of the sheet R32 which is fed from the feeding mechanism 51 and is sent by the pair of the paper feeding rollers (52, 53) is not held until reaching the pair of the transport rollers (15, 16), the outside face R6 of the sheet is likely to come into contact with the inner face 32 of the outer circumference side. Here, if the rib is arranged on the inner face 32 of the outer circumference side as the inner face 31 of the inner circumference side, the contact area between the outside face R6 of the sheet and the inner face 32 of the outer circumference side is reduced. As a result, the scratch of the outside face R6 of the sheet is more likely to occur. As shown in FIG. 5 and FIG. 6, in the recording apparatus 1, since the inner face 32 of the outer circumference side is formed into the shape having a curved face without the rib of which the longitudinal direction is toward the transport direction D4, the force which is applied to the outside face R6 of the sheet is dispersed, and it is possible to suppress the damage of the outside face R6 of the sheet due to the contact with the inner face 32 of the medium path having the shape which is concave toward the opposite side of the transported sheet R3 at the time of feeding the paper.

Furthermore, the invention includes various modification examples.

For example, the recording medium to which the invention can be applied may be continuous paper which is folded, cut paper or the like, other than the rolled paper.

The recording apparatus may be the apparatus that performs the recording on one recording medium, other than the recording apparatus that performs the recording by switching the plurality of the recording mediums.

The first roller and the second roller may include the drive roller.

When the medium path is bent into a S-shape or the like, the inner face of the medium path of the portion which bulges toward the transported recording medium is the first inner face, and the inner face of the medium path of the portion which is concave toward the opposite side of the transported recording medium is the second inner face. Therefore, the concave second inner face may be connected to the downstream side of the medium path of the bulging first inner face or the bulging first inner face may be connected to the downstream side of the medium path of the concave second inner face.

In the medium path, the interval between the first inner face and the second inner face may not be constant. For example, if the shape in which the inner face of the inner circumference side bulges toward the transported sheet is formed, the inner face of the outer circumference side may not be concave toward the opposite side of the sheet. For example, the inner face of the outer circumference side may have a plane shape. If the plurality of the first rollers are arranged on the inner face of the inner circumference side, it is possible to obtain the effect that the damage of the recording medium due to the contact with the inner face of the inner circumference side is suppressed.

Furthermore, if the inner face of the outer circumference side has the shape which is concave toward the opposite side of the transported sheet, the inner face of the inner circumference side may not bulge toward the sheet. For example, the inner face of the inner circumference side may have the plane shape. If the second roller is arranged on the inner face of the outer circumference side, it is possible to obtain the effect that the damage of the recording medium due to the contact with the inner face of the outer circumference side is suppressed at the time of supplying the recording medium.

From the above, according to another aspect of the invention, the recording apparatus according to the invention includes the medium supporting section that supports the recording medium, the recording section that performs the recording on the recording medium, and the medium path that has the first inner face and the second inner face between which the recording medium is transported, in which the second inner face has the shape which is convex toward the opposite side of the transported recording medium, the roller is arranged on the second inner face.

That is, since the roller is arranged on the inner face of the medium path having the shape which is concave to the opposite side of the transported recording medium, it is possible to suppress the scratch of the recording medium directly on the inner face of the medium path having the concave shape. Therefore, in this case, it is possible to provide the recording apparatus that can suppress the damage of the recording medium due to the contact with the inner face of the medium path having the shape which is concave to the opposite side of the recording medium at the time of supplying the recording medium.

As described above, according to the invention, it is possible to provide the technology that can to suppress the damage of the recording medium due to the contact with the inner face of the medium path in accordance with various embodiments. Naturally, even in the technology which is formed by only configuration elements according to independent claims and the separate aspects described above without the configuration elements according to the dependent claims, the basic operations and the effects described above can be obtained.

Furthermore, it is possible to provide the alteration configuration that is obtained by replacing or combining the various configurations which are disclosed in the embodiments and the modification examples described above, the alteration configuration that is obtained by replacing or combining the various configurations which are disclosed in a well-known technology, the embodiments and the modification examples described above, or the like. The invention also includes the configurations described above.

The entire disclosure of Japanese Patent Application No. 2013-065785, filed Mar. 27, 2013 is expressly incorporated by reference herein.

What is claimed is:

1. A recording apparatus comprising:

a medium supporting section that supports a recording medium;

a recording section that performs a recording on the recording medium; and a medium path that has a first face and a second face facing each other, and that transports the recording medium through between the first face and the second face, wherein the first face has a shape which is convex toward the second face, and a plurality of rollers which are lined up in a transport direction of the recording medium are arranged on the first face, wherein the second face has a shape which is concave toward an opposite side of the first face, and a second roller is arranged on the second face, and wherein the second roller is arranged on the second face of a position which is located between the two adjacent rollers that are arranged on the first face in the transport direction.

2. The recording apparatus according to claim 1, wherein a common tangent of the two adjacent rollers in the transport direction does not come into contact with the first face which is located between the two rollers in the medium path.

3. The recording apparatus according to claim 1, wherein on the first face, an extending section is formed along the transport direction.

4. The recording apparatus according to claim 1, wherein the second face is formed into a curved shape.

* * * * *